US008371273B2

(12) United States Patent
Ulrey et al.

(10) Patent No.: US 8,371,273 B2
(45) **Date of Patent: *Feb. 12, 2013**

(54) BIDIRECTIONAL ADSORBENT-CANISTER PURGING

(75) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/417,068

(22) Filed: Mar. 9, 2012

(65) Prior Publication Data

US 2012/0174897 A1 Jul. 12, 2012

Related U.S. Application Data

(63) Continuation of application No. 12/535,359, filed on Aug. 4, 2009, now Pat. No. 8,132,560.

(51) Int. Cl.
*F02M 33/02* (2006.01)

(52) U.S. Cl. ..... 123/521; 123/572; 123/559.1

(58) Field of Classification Search ..... 123/447, 123/456, 457, 461, 514, 516, 518–521, 564–565, 123/572, 574, 559.1
See application file for complete search history.

(56) References Cited

U.S. PATENT DOCUMENTS

| | | | | |
|---|---|---|---|---|
| 2,191,940 | A | 2/1940 | Meckl | |
| 3,306,035 | A | 2/1967 | Morrell | |
| 3,618,314 | A | 11/1971 | Krebs | |
| 3,675,634 | A | 7/1972 | Tatsutomi et al. | |
| 3,745,984 | A | 7/1973 | King | |
| 4,557,226 | A | 12/1985 | Mayer et al. | |
| 4,962,745 | A | 10/1990 | Ohno et al. | |
| 4,982,715 | A | 1/1991 | Foster | |
| 5,005,550 | A | 4/1991 | Bugin et al. | |
| 5,429,101 | A | 7/1995 | Uebelhoer et al. | |
| 5,531,188 | A | 7/1996 | Tomasulo | |
| 5,979,418 | A | 11/1999 | Saruwatari et al. | |
| 6,138,644 | A | 10/2000 | Saruwatari et al. | |
| 6,722,129 | B2 | 4/2004 | Criddle et al. | |
| 6,892,715 | B2 | 5/2005 | Norrick | |
| 6,910,467 | B2 | 6/2005 | Murakami et al. | |
| 7,284,541 | B1 | 10/2007 | Uchida | |
| 7,743,752 | B2 | 6/2010 | Kerns et al. | |
| 7,784,449 | B2 | 8/2010 | Maly | |
| 7,918,214 | B2 | 4/2011 | Kerns et al. | |
| 8,109,259 | B2 | 2/2012 | Ulrey et al. | |
| 8,132,560 | B2 * | 3/2012 | Ulrey et al. | 123/521 |
| 2001/0022175 | A1 | 9/2001 | Moren | |
| 2004/0112346 | A1 | 6/2004 | Ahlborn et al. | |
| 2007/0107709 | A1 | 5/2007 | Moncelle et al. | |
| 2008/0083399 | A1 | 4/2008 | Hirano et al. | |
| 2008/0110443 | A1 | 5/2008 | Hirano | |
| 2010/0012103 | A1 | 1/2010 | Lewis et al. | |
| 2011/0030658 | A1 | 2/2011 | Ulrey et al. | |

* cited by examiner

*Primary Examiner* — Hai Huynh
(74) *Attorney, Agent, or Firm* — Julia Voutyras; Alleman Hall McCoy Russell & Tuttle LLP

(57) ABSTRACT

A method for combusting a vapor of a fuel accumulated in an adsorbent canister in a vehicle, the vehicle having an engine and a fuel tank coupled to the adsorbent canister. The method comprises, during a first operating condition including a higher availability of compressed air, metering the compressed air from a first air source, and flowing the metered, compressed air through the adsorbent canister along a first flow path. The method further comprises, during a second operating condition including a lower availability of compressed air, flowing air from a second air source through the adsorbent canister, and, during the first and second operating conditions, venting the fuel tank to an intake of the engine and flowing effluent enriched in the vapor from the adsorbent canister to the intake of the engine.

17 Claims, 7 Drawing Sheets

BIDIRECTIONAL ADSORBENT-CANISTER PURGING

The present application is a continuation of U.S. patent application Ser. No. 12/535,359 filed Aug. 4, 2009, now U.S. Pat. No. 8,132,560, the entire contents of which are incorporated herein by reference for all purposes.

TECHNICAL FIELD

The present application relates to the field of emissions control in vehicles, and more particularly, to crankcase ventilation and fuel-tank pressure relief.

BACKGROUND AND SUMMARY

In a motor-vehicle engine system, fuel from a fuel tank is intended to flow to the combustion chambers of the engine with unit efficiency, such that no fuel is released into the atmosphere. In practice, various measures are taken to recapture fuel that has escaped its intended flow path and might otherwise be released into the atmosphere as vapor. Such fuel is typically redirected to the intake manifold of the engine.

For instance, a positive crankcase ventilation (PCV) system may be used to recapture and combust fuel vapor that has entered the crankcase. In addition, fuel vapor vented from the fuel tank (whether the motor vehicle is operating, resting, or being refueled) may be temporarily trapped in an adsorbent canister and delivered to the intake manifold during a subsequent purge of the adsorbent canister. In motor-vehicle engine systems used today, the crankcase and adsorbent canister, maintained near atmospheric pressure by coupling to an air cleaner, may each communicate with the intake manifold via a control valve. The vacuum that may be present at the intake manifold provides a motive force to draw fuel vapor from the crankcase and/or adsorbent canister and into the engine, where it is combusted.

Crankcase ventilation and fuel-vapor purging as described above may be effective and reliable so long as sufficient vacuum is available at the intake manifold. In boosted engine systems, however, sufficient vacuum may be unavailable during some operating conditions, such as during medium- or high-level boost. One solution to this problem is to provide a supplementary source of vacuum such as an electrically driven vacuum pump to purge fuel vapor from the crankcase and/or adsorbent canister when intake manifold vacuum is not available. However, this approach increases engine-system cost and complexity.

Alternative approaches that provide adsorbent-canister purging driven by positive pressure instead of manifold vacuum have appeared (e.g., U.S. Pat. No. 7,284,541). However, this approach may not provide effective purging when the manifold air pressure is close to barometric pressure. Further, it maintains the fuel tank at less than barometric pressure during some operating conditions, potentially increasing the rate of emission of vapor from the fuel tank and the required purge frequency. Therefore, one embodiment provides a method for combusting a vapor of a fuel accumulated in an adsorbent canister in a vehicle, the vehicle having an engine and a fuel tank coupled to the adsorbent canister. The method comprises, during a first operating condition including a higher availability of compressed air, metering the compressed air from a first air source, and flowing the metered, compressed air through the adsorbent canister along a first flow path. The method further comprises, during a second operating condition including a lower availability of compressed air, flowing air from a second air source through the adsorbent canister, and, during the first and second operating conditions, venting the fuel tank to an intake of the engine and flowing effluent enriched in the vapor from the adsorbent canister to the intake of the engine.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

DETAILED DESCRIPTION

The subject matter of the present disclosure is now described by way of example and with reference to certain illustrated embodiments. Components that may be substantially the same in two or more embodiments are identified coordinately and are described with minimal repetition. It will be noted, however, that components identified coordinately in different embodiments of the present disclosure may be at least partly different. It will be further noted that the drawings included in this disclosure are schematic. Views of the illustrated embodiments are generally not drawn to scale; aspect ratios, feature size, and numbers of features may be purposely distorted to make selected features or relationships easier to see.

Figure 1:
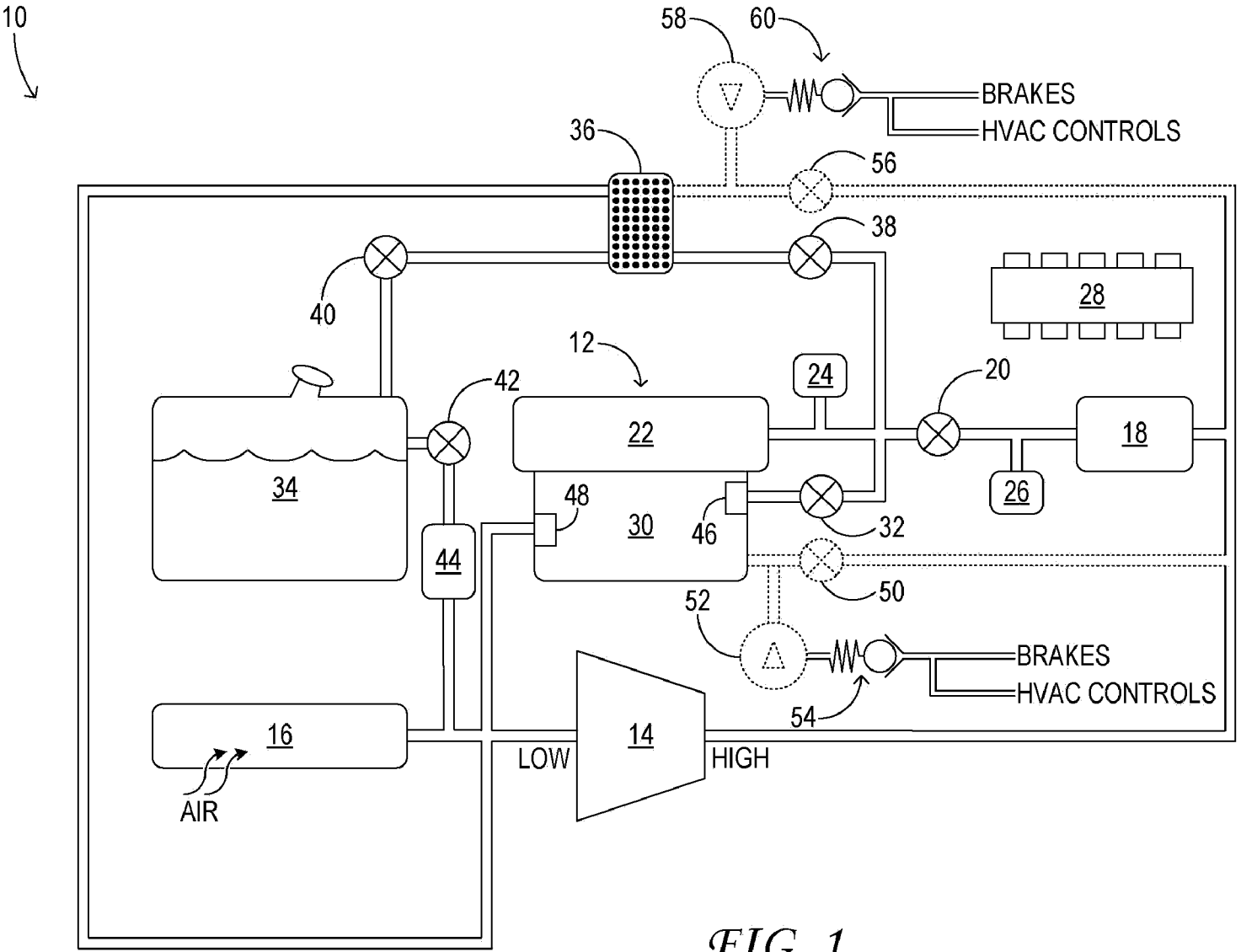
FIGS. 1-4 show engine systems configured for combusting a vapor of a fuel accumulated in at least one engine-system component in a vehicle, in accordance with different embodiments of the present disclosure.

FIG. 1 shows aspects of an example engine system 10 for a motor vehicle. The engine system is configured for combusting fuel vapor accumulated in at least one component thereof. The engine system includes engine 12 and turbocharger compressor 14.

Engine 12 may be virtually any volatile-liquid or gas-fueled internal combustion engine, e.g., a port- or direct-injection gasoline engine or diesel engine. In one, non-limiting embodiment, the engine may be adapted to consume an alcohol-based fuel—ethanol, for example. Turbocharger compressor 14 may be mechanically coupled to and driven by a turbine powered by hot exhaust gas flowing from the engine. In the configuration illustrated in FIG. 1, the turbocharger compressor draws fresh air from air cleaner 16 and flows compressed air through intercooler 18. The intercooler cools the compressed air, which then flows via throttle valve 20 to intake manifold 22.

Engine system 10 includes at least two air-pressure sensors: manifold air-pressure sensor 24 fluidically coupled to an air conduit downstream of throttle valve 20, and throttle-inlet air-pressure sensor 26 fluidically coupled to an air conduit upstream of throttle valve 20. Each air-pressure sensor may be responsive to an absolute or relative pressure of air in the conduit to which it is coupled. In embodiments where the air-pressure sensors are responsive to an absolute pressure of air, the engine system may also include a barometric air-pressure sensor.

Each air-pressure sensor in engine system 10 is operatively coupled to electronic control system 28, which may be any electronic control system of the engine system or of the vehicle in which the engine system is installed. Accordingly, the electronic control system may be configured to make control decisions, actuate valves, etc., based at least partly on the air pressures sensed within the engine system.

Intake manifold 22 is configured to supply intake air or an air-fuel mixture to a plurality of combustion chambers of engine 12. The combustion chambers may be arranged above a lubricant-filled crankcase 30, in which reciprocating pistons of the combustion chambers rotate a crankshaft. The reciprocating pistons may be substantially isolated from the crankcase via one or more piston rings, which suppress the flow of the air-fuel mixture and of combustion gasses into the crankcase. Nevertheless, a significant amount of fuel vapor may 'blow by' the piston rings and enter the crankcase over time. To reduce the degrading effects of the fuel vapor on the viscosity of the engine lubricant and to reduce the discharge of the vapor into the atmosphere, the crankcase may be continuously or periodically ventilated, as further described hereinafter. In the configuration shown in FIG. 1, post-throttle crankcase-ventilation valve 32 controls the admission of ventilation air into the crankcase. The post-throttle crankcase-ventilation valve may be any fixed or adjustable portioning valve.

Engine system 10 includes fuel tank 34, which stores the volatile liquid fuel combusted in engine 12. To avoid emission of fuel vapors from the fuel tank and into the atmosphere, the fuel tank is vented to the atmosphere through adsorbent canister 36. The adsorbent canister may have a significant capacity for storing hydrocarbon-, alcohol-, and/or ester-based fuels in an adsorbed state; it may be filled with activated carbon granules and/or another high surface-area material, for example. Nevertheless, prolonged adsorption of fuel vapor will eventually reduce the capacity of the adsorbent canister for further storage. Therefore, the adsorbent canister may be periodically purged of adsorbed fuel, as further described hereinafter. In the configuration shown in FIG. 1, post-throttle canister-purge valve 38 controls the admission of purge air into the adsorbent canister.

To provide venting of fuel tank 34 during refueling, adsorbent canister 36 is coupled to the fuel tank via refueling tank vent 40. The refueling tank vent may be a normally closed valve which is held open during refueling. To provide venting of the fuel tank while the engine is running, engine-running tank vent 42 is provided. The engine-running tank vent may be a normally closed tank vent which is held open while the engine is running. The engine-running tank vent, when open, may conduct vapors from the fuel tank to the low pressure side of turbocharger compressor 14. In the configuration illustrated in FIG. 1, fuel vapors are conducted to the low-pressure side of the turbocharger compressor via buffer 44. The buffer may be any structure configured to reduce or restrict the admission of transient slugs of fuel vapor into the clean air intake conduit. Such slugs of fuel vapor could be caused by tank slosh, for example. The buffer may comprise one or more baffles, screens, orifices, etc.

The configuration illustrated in FIG. 1 ensures that during refueling, air from fuel tank 34, now stripped of fuel vapor, may be vented to atmospheric pressure. During other conditions, e.g., during a system integrity test, refueling tank vent 40 and engine-running tank vent 42 may be closed so that it can be determined whether some isolated part of engine system 10 can hold pressure or vacuum. In some embodiments, throttle valve 20, post-throttle crankcase-ventilation valve 32, post-throttle canister-purge valve 38, and tank vents 40 and 42 may be electronically controlled valves operatively coupled to electronic control system 28 to facilitate such diagnostics, and other features of engine operation.

Continuing in FIG. 1, post-throttle crankcase-ventilation valve 32 is shown coupled to intake manifold 22 and to crankcase 30 via intake-protecting oil separator 46. Via compressor-protecting oil separator 48, crankcase 30 is further coupled to the low-pressure side of turbocharger compressor 14. Two oil separators are included because the basic configuration shown in FIG. 1 enables bidirectional crankcase ventilation, as described below.

In one embodiment, the direction of ventilation air flow through the crankcase depends on the relative values of the manifold air pressure (MAP) and the barometric pressure (BP). Under unboosted or minimally boosted conditions (e.g., when BP>MAP), air enters the crankcase from air cleaner 16 and is discharged from the crankcase to intake manifold 22, as in conventional PCV systems. However, under more highly boosted conditions (e.g., when MAP>BP), compressed air enters the crankcase from the intake manifold, and is discharged from the crankcase to the low-pressure side of turbocharger compressor 14.

An advantage over the basic configuration of FIG. 1 is provided by including in engine system 10 another ventilation path, which is shown in dashed lines. In this configuration, pre-throttle crankcase-ventilation valve 50 couples crankcase 30 to the high-pressure side of turbocharger compressor 14. The pre-throttle crankcase-ventilation valve may be any fixed or adjustable portioning valve. Here, the path of ventilation air flow through the crankcase depends on the relative values of BP, MAP, and the throttle-inlet pressure (TIP). Along a first flow path active under unboosted or minimally boosted conditions, air enters the crankcase from air cleaner 16 when BP>MAP, and is discharged from the crankcase to the intake manifold, as in conventional PCV systems. However, along a second flow path active under more highly boosted conditions, when TIP>BP, for example, compressed air enters the crankcase from the high-pressure side of the turbocharger compressor, flows through the crankcase, and is discharged from the crankcase to the low-pressure side of the turbocharger compressor. Because TIP is greater than MAP for any significant air flow rate, the first and second flow paths may be active simultaneously, so that the crankcase remains actively ventilated even when BP and MAP are substantially the same.

Another advantage over the basic configuration of FIG. 1 is provided by including in engine system 10 a supplemental source of pressure for crankcase ventilation. Thus, FIG. 1 shows in dashed lines pump 52 configured to provide compressed air to crankcase 30. In some embodiments, pump 52 may be a vacuum pump coupled to the power brake, waste gate-actuator, and/or heating, ventilation, and air-conditioning (HVAC) systems of the vehicle in which the engine system is installed. In the illustrated configuration, such coupling is provided via check valve 54 that prevents the backflow of fuel vapor into the power brake, waste gate-actuator, and/or HVAC systems. In configurations that include pump 52 or the like, the crankcase ventilation air flow may be substantially unidirectional. Therefore, the ventilation path comprising post-throttle crankcase-ventilation valve 32 and intake-protecting oil separator 46 may be omitted from some engine-system configurations consistent with the present disclosure.

The basic configuration illustrated in FIG. 1 further enables bidirectional adsorbent canister purging in multiple embodiments. Post-throttle canister-purge valve 38 is shown coupled directly to intake manifold 22. Accordingly, the path of purge-air flow through the adsorbent canister may depend on the relative values of MAP and BP. In particular, under unboosted or minimally boosted conditions (e.g., when BP>MAP) air enters the adsorbent canister from air cleaner 16 during a purge and is discharged from the adsorbent canister to the intake manifold, as in conventional engine systems. However, under boosted conditions (e.g., when MAP>BP) compressed air enters the adsorbent canister from the intake manifold, and is discharged from the adsorbent canister to the low-pressure side of turbocharger compressor 14.

An advantage over the basic configuration of FIG. 1 is provided by including in engine system 10 another adsorbent-canister purge path, which is shown in dashed lines. In this configuration, pre-throttle canister-purge valve 56 couples adsorbent canister 36 to the high-pressure side of turbocharger compressor 14. Accordingly, the path of purge-air flow through the adsorbent canister depends on the relative values of BP, MAP, and TIP. Along a first flow path, active under unboosted or minimally boosted conditions, when BP>MAP, air enters the adsorbent canister from air cleaner 16 and is discharged from the adsorbent canister to intake manifold 22, as in a conventional canister-purge system. However, in a second flow path active under boosted conditions, when TIP>BP, for example, compressed air enters the adsorbent canister from the high-pressure side of the turbocharger compressor, flows through the adsorbent canister and is discharged from the adsorbent canister to the low-pressure side of the turbocharger compressor. Because TIP>MAP for any significant air-flow rate, the first and second flow pathways may be active simultaneously, so that adsorbent-canister purging is possible even when BP and MAP are substantially the same.

Another advantage over the basic configuration of FIG. 1 is provided by including in engine system 10 a supplemental source of pressure for adsorbent-canister purging. Thus, FIG. 1 shows pump 58 configured to provide compressed air to adsorbent canister 36. In some embodiments, pump 58 may be a vacuum pump coupled to the power brake, waste gate-actuator, and/or HVAC systems of the vehicle in which the engine system is installed. In this embodiment, such coupling is provided via check valve 60 that prevents the backflow of fuel vapor into the power brake, waste gate-actuator, and/or HVAC systems. In some embodiments, pumps 52 and 58 may be the very same pump; in other embodiments, they may be different pumps.

It will be evident, upon examining FIG. 1, that adsorbent canister purging may also be enacted under boosted conditions (TIP>BP) by actuating pre-throttle canister-purge valve 56 and holding post-throttle canister-purge valve 38 closed. Similarly, crankcase ventilation may be enacted under boosted conditions (TIP>BP) by actuating pre-throttle crankcase-ventilation valve 50 and holding post-throttle crankcase-ventilation valve 32 closed. Accordingly, some embodiments are contemplated where one or both of post-throttle canister-purge valve 38 and post-throttle crankcase-ventilation valve 32, as well as the conduits linking these valves to intake manifold 22, are omitted from the engine-system configuration.

Finally with regard to FIG. 1, it will be noted that crankcase 30 and adsorbent canister 36 are maintained at near atmospheric pressures over a wide range of operating conditions. This allows for conventional component design. Moreover, the purging of both the adsorbent canister and the crankcase may handled in an analogous, coordinate manner. As the exit streams from both purge pathways merge, fuel vapor can act as a solvent for the oil residue entrained in or deposited by the crankcase ventilating flow.

Figure 2:
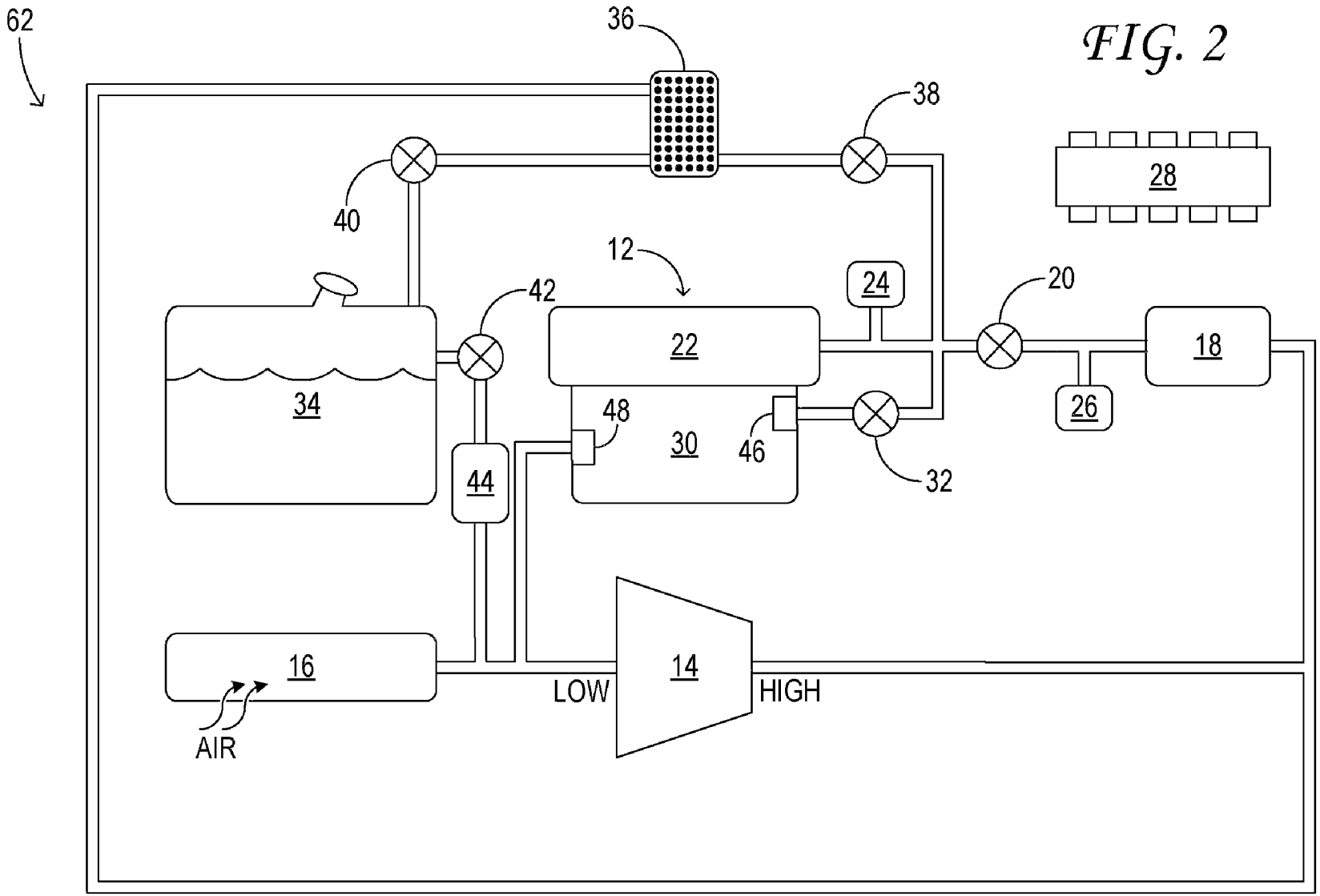

FIG. 2 shows aspects of another example engine system 62 for a motor vehicle. The engine system is configured for combusting a vapor of a fuel accumulated in at least one component thereof. In this configuration, adsorbent canister 36 is fluidically coupled to the high-pressure side of turbocharger compressor 14, and further coupled to intake manifold 22 through post-throttle canister-purge valve 38. Accordingly, warm, compressed air may provided to purge the adsorbent canister whenever TIP>MAP. It is noted that embodiments in accordance with FIGS. 1 and 2 enable efficient purging of the adsorbent canister without applying vacuum to the fuel tank, as conventional adsorbent-canister purge systems may. By applying vacuum to the fuel tank, the conventional systems may accelerate the emission of fuel vapor from the fuel tank. The configuration shown in FIG. 2 subjects the adsorbent canister to compressor outlet pressure (TIP). All other aspects being equal, the low air pressure and high purge air temperature in this embodiment may be advantageously effective in purging the fuel vapor from the canister adsorbent.

Figure 3:
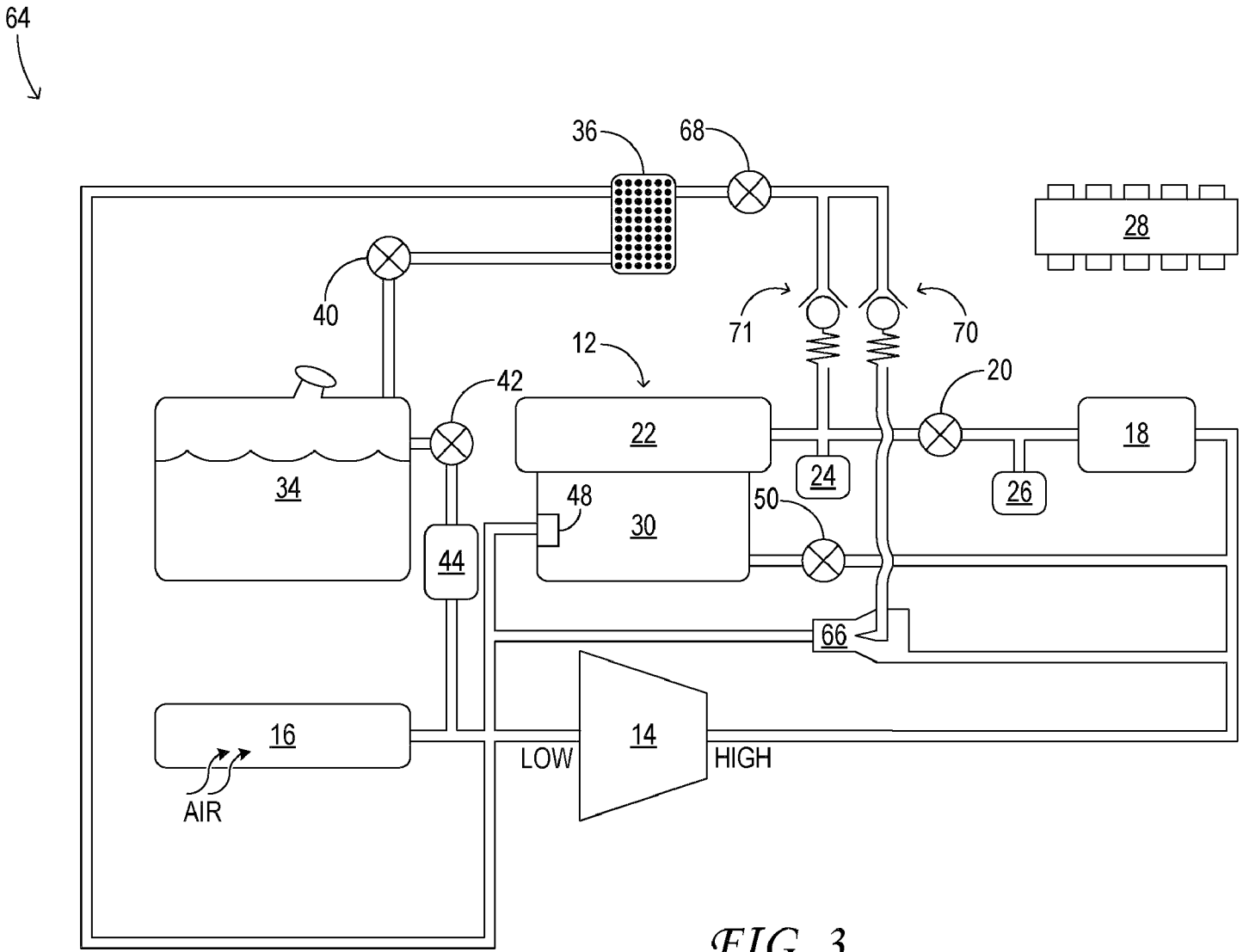

FIG. 3 shows aspects of another example engine system 64 for a motor vehicle. The engine system is configured for combusting a vapor of a fuel accumulated in at least one component thereof. In this embodiment, some of the compressed air flow from the high-pressure side of turbocharger compressor 14 is returned to the low-pressure side via air ejector 66. The air ejector may be any device configured to conduct a flow of air from a high-pressure primary inlet to a low pressure primary outlet, and thereby induce a partial vacuum at a secondary inlet. In one embodiment, the air ejector may be a passive device comprising a venturi-type passage and having no solid, moving parts. In the configuration illustrated in FIG. 3, the secondary inlet of the air ejector is fluidically coupled to canister-purge valve 68 via check valve 70, and is thereby configured to provide partial vacuum for purging adsorbent canister 36 whenever boost is available, e.g., when TIP>BP.

When boost is not available, but MAP<BP, adsorbent canister 36 may be evacuated into intake manifold 22 via check valve 71. Thus, the vacuum created by air ejector 66 under a first set of operating conditions or by the intake manifold under a second set of operating conditions may be used to purge fuel vapor from the adsorbent canister. In this manner, vacuum for adsorbent-canister purging is made available over an extended range of operating conditions.

Figure 4:
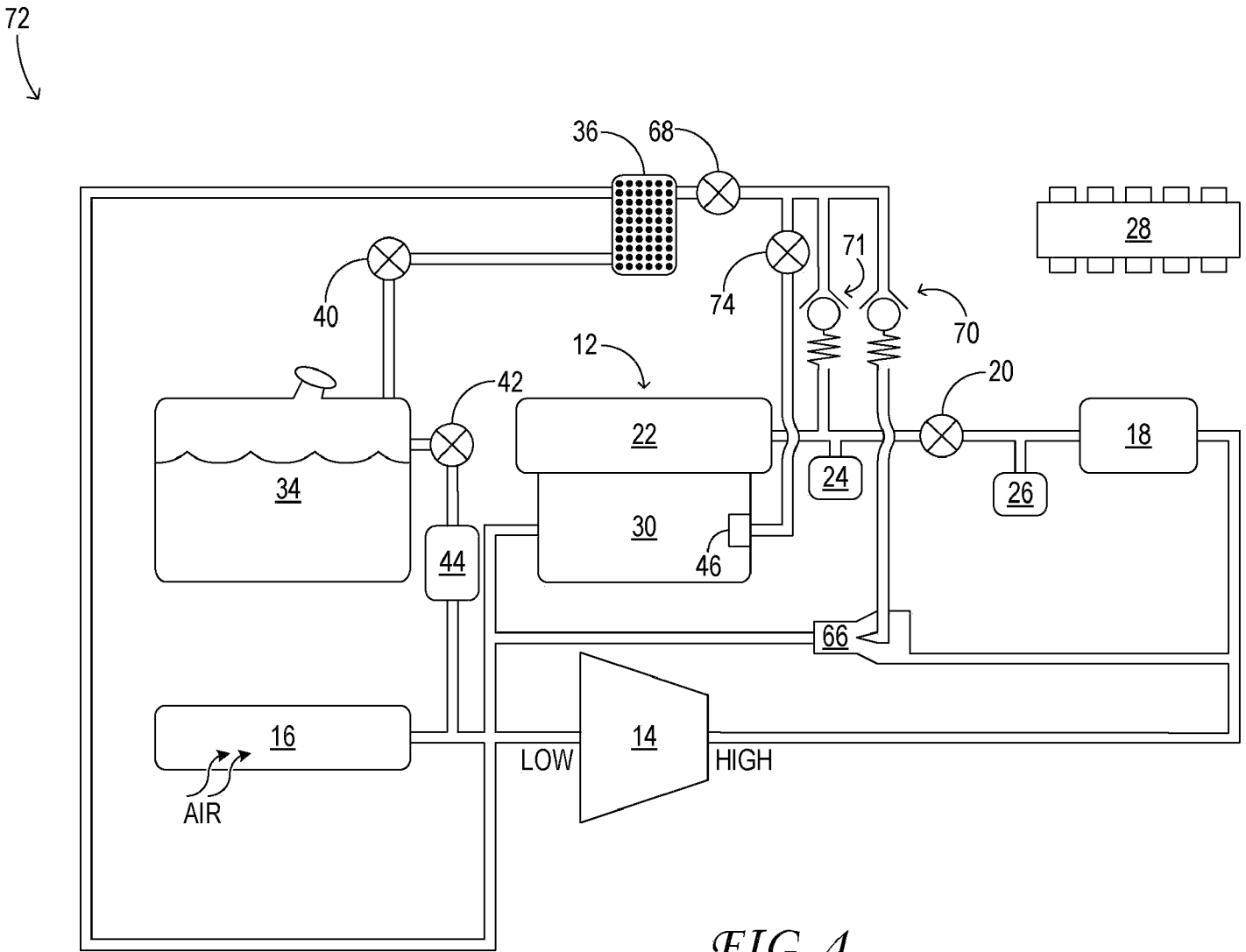

FIG. 4 shows aspects of another example engine system 72 for a motor vehicle. The engine system is configured for combusting a vapor of a fuel accumulated in at least one component thereof. In this configuration, the intake manifold and the secondary inlet of the air ejector are coupled to canister-purge valve 68 and further coupled to crankcase-ventilation valve 74. In this manner, the air ejector is configured to provide vacuum for ventilating crankcase 30 and for purging adsorbent canister 36 whenever boost is available, viz., when TIP>BP. When boost is not available, but MAP<BP, crankcase-ventilation and adsorbent-canister purge flow are directed instead to the intake manifold.

Figure 5:
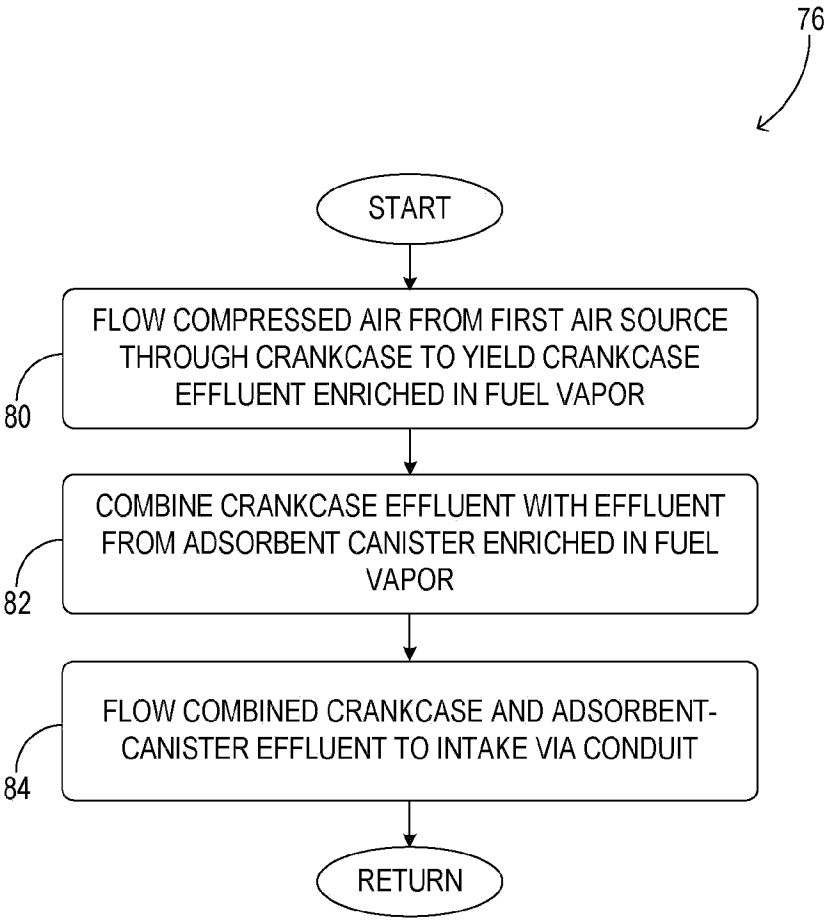

Each of the configurations shown above provides an oil separator coupled to the location on crankcase 30 where crankcase-ventilation air flow is discharged. This measure protects compressor blades, intercoolers, control valves, and other downstream components from fouling due to excessive accumulation of lubricant oil. However, the embodiments shown in FIGS. 4 and 5 provide even greater protection of these components by mixing crankcase effluent with effluent from adsorbent canister 36 during canister-purge. In this manner, lubricant-free fuel vapors from the adsorbent canister 'chase' the lubricant-entrained air down the air conduit and into turbocharger compressor 14. Therefore, the potential for fouling due to lubricant oil accumulation may be further decreased.

The configurations illustrated above enable various methods for combusting a vapor of a fuel accumulated in at least one engine-system component in a vehicle. Accordingly, some such methods are now described, by way of example, with continued reference to the above configurations. It will be understood, however, that the disclosed methods, and others fully within the scope of the present disclosure, may be enabled via other configurations as well.

The methods presented herein include various computation, comparison, and decision-making actions, which may be enacted via an electronic control system (e.g., electronic control system 28) of the engine system or of a vehicle in which the engine system is installed. The methods further include various measuring and/or sensing actions that may be enacted via one or more sensors disposed in the fuel system (pressure sensors, etc.)—operatively coupled to the electronic control system, as described in the example configurations hereinabove. The methods further include various valve-actuating events, which the electronic control system may enact in response to the various decision-making actions.

FIG. 5 illustrates an example method 76 for combusting a vapor of a fuel accumulated in a crankcase of an engine, the engine disposed in a vehicle having a fuel tank and an adsorbent canister coupled to the fuel tank. Method 76 and subsequent methods are applicable to various fuels: gasoline, diesel fuel, biodiesel, and alcohol-based fuels, for example. In one, non-limiting embodiment, the fuel may comprise ethanol.

Method 76 may be entered upon during a first operating condition of the vehicle. The first operating condition may be defined and characterized based on the relative air pressures at different locations within the engine system. Specifically, the first operating condition may be characterized by a relatively high availability of compressed air in the engine system. In one embodiment, the first operating condition may be characterized by a manifold air pressure of the engine exceeding barometric pressure (MAP>BP). In another embodiment, the first operating condition may be characterized by a throttle-inlet pressure of the engine exceeding barometric pressure (TIP>BP). In yet another embodiment, the first operating condition may be characterized by a throttle-inlet pressure of the engine exceeding a manifold air pressure of the engine (TIP>MAP).

Equivalently, the first operating condition may be defined in terms of a quantity and a threshold. Thus, method 76 may be entered upon when the TIP or MAP exceeds a predetermined threshold: BP or MAP, for example.

Method 76 begins at 80, where compressed air from a first air source is flown through a crankcase of the engine (e.g., crankcase 30) to yield a crankcase effluent enriched in the combustion chamber leaked gases accumulated therein, which include the fuel vapor. In some embodiments, the first air source may be a compressor coupled to the engine. The compressor may be a supercharger compressor or an exhaust-gas driven turbocharger compressor, such as turbocharger compressor 14 shown above. Accordingly, metering the compressed air may comprise drawing a regulated flow of air from the compressor. In these and other embodiments, metering the compressed air may further comprise restricting the flow of the compressed air via one or more portioning valves—fixed or adjustable, electronically controlled valves, for example.

In some embodiments, the compressed air may be flown through the crankcase along a particular flow path, i.e., a first flow path to be distinguished from subsequent flow paths referred to hereinafter. It will be understood that the term 'flow path', as used herein, subsumes a particular region through which air flow is conducted as well as a particular direction of air flow through that region. In other words, first and second flow paths may be distinguished from each other because they comprise different regions or because they support air flow through the same region, but in different (e.g., opposite) directions.

Method 76 then advances to 82, where the crankcase effluent is combined with effluent from an adsorbent canister also enriched in the vapor of the accumulated fuel. Equivalently, effluent from the adsorbent canister is mixed into the crankcase effluent. The method then advances to 84, where the combined crankcase and adsorbent-canister effluent is flown to an intake of the engine via the same conduit. In this manner, lubricant-free fuel vapors may chase the crankcase effluent through the conduit, across one or more valves or sensors, into the compressor inlet, etc. In chasing the crankcase effluent, the lubricant-free fuel vapors carried in the canister effluent may effectively mix with and solubleize deposits of engine lubricant that may have accumulated on these surfaces. Such action may reduce the potential for fouling sensors, valves, compressor blades, intercoolers, etc., due to excessive accumulation of lubricant. In some embodiments, flowing the combined crankcase and adsorbent-canister effluent into the intake of the engine may comprise admitting the combined effluent to a compressor en route to the intake of the engine. Following 84, method 76 returns.

Related methods for combusting a vapor of a fuel accumulated in the crankcase may include additional steps not shown in FIG. 5. Such additional steps may be appreciated with reference to the example configurations shown in FIGS. 1-4. For example, one method may include cooling the compressed air before metering and before flowing through the crankcase. The cooling may be enacted via an intercooler (e.g., intercooler 18). In another embodiment, the compressed air may be flowed through a throttle valve coupled to the intake of the engine before metering and before flowing through the crankcase. In these and other embodiments, the method may further comprise flowing the compressed air through a metering valve different than the throttle valve before flowing through the crankcase.

In further embodiments, methods for combusting a vapor of a fuel accumulated in the crankcase may further comprise flowing some compressed air from the compressor through a venturi device configured to draw canister effluent from the adsorbent canister and into the crankcase effluent. Here, as described above, lubricant-free fuel vapors may chase the crankcase effluent into the compressor inlet, thereby reducing the potential for fouling the various engine-system components due to excessive accumulation of lubricant.

Figure 6:
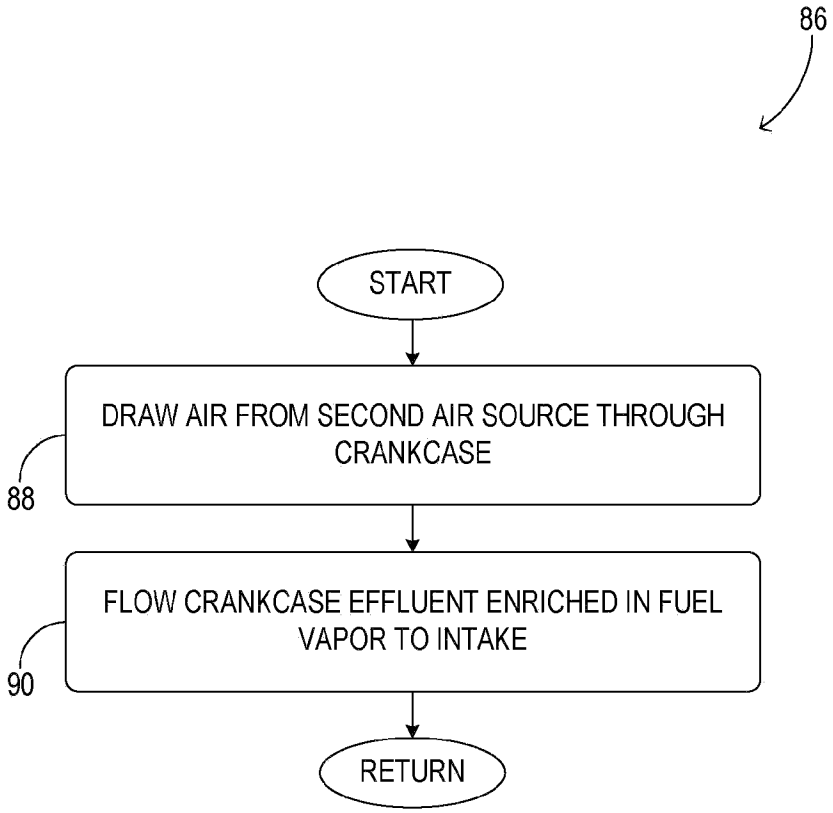
FIGS. 5 and 6 illustrate methods for combusting a vapor of a fuel accumulated in a crankcase of an engine of a vehicle, in accordance with different embodiments of the present disclosure.

FIG. 6 illustrates another example method 86 for combusting a vapor of a fuel accumulated in a crankcase of an engine, the engine disposed in a vehicle having a fuel tank and an adsorbent canister coupled to the fuel tank. Method 86 may be entered upon during a second operating condition of the vehicle characterized by a relatively low availability of compressed air (relative to the first operating condition, at least). Like the first operating condition, the second operating condition may be defined and characterized based on the relative air pressures at different locations within the engine system. In one embodiment, the second operating condition may be characterized by a manifold air pressure of the engine being less than the barometric pressure (MAP<BP). In another embodiment, the second operating condition may be characterized by the throttle-inlet pressure of the engine being less than the barometric pressure (TIP<BP).

Method 86 begins at 88, where air from a second air source is drawn through the crankcase. As a result, the crankcase effluent may become enriched in the vapor of the fuel accumulated therein. In some embodiments, the second air source may be the atmosphere. In these and other embodiments, drawing the air through the crankcase may comprise flowing the air along a second flow path, different than the first flow path—i.e., different than the flow path through which metered, compressed air flows during the first operating condition. In other embodiments, the second air source may be a vacuum pump discharge of the vehicle. In these and other embodiments, drawing the air through the crankcase may comprise flowing the air along the first flow path.

Method 86 then advances to 90, where the crankcase effluent enriched in the vapor of the accumulated fuel is flown to the intake of the engine. In some embodiments, the crankcase effluent that flows to the intake during the second operating condition may be combined with effluent from another engine-system component—the adsorbent canister, for example. Following 90, method 86 returns.

Other embodiments provide related or extended methods applicable to conditions when compressed air is of relatively low availability in the engine system. One such method may further comprise metering the crankcase effluent as it exits the crankcase. The crankcase effluent may be metered by restricting its flow via a metering valve, for example.

Methods 76 and 86 or related methods may, in some embodiments, be coordinated to yield composite methods applicable to operating conditions when compressed air is relatively plentiful and to operating conditions when compressed air is less plentiful. In such embodiments, the first and second operating conditions, as defined above, may be exclusive of each other. For example, the first operating condition may be characterized by MAP>BP, and the second operating condition may be characterized by MAP<BP. In other embodiments, however, the first and second operating conditions may overlap with each other, such that at least some air flows through the engine-system component along the first and second flow paths simultaneously. This may occur, for example, when the first operating condition is characterized by TIP>BP, and the second operating condition is characterized by MAP<BP. Whether or not the first and second operating conditions are exclusive of each other, the configurations shown hereinabove enable combined crankcase effluent and adsorbent-canister effluent to be flown to the intake of the engine during the first operating condition and during the second operating condition.

Further coordination between crankcase ventilation, on the one hand, and canister purging, on the other hand, is contemplated. For example, compressed air from the first air source may be used both for crankcase ventilation and for canister purging; in such embodiments, the compressed air may be flown into the adsorbent canister to effect a purge only when the metered, compressed air is flowing through the crankcase along the first flow path.

Figure 7:
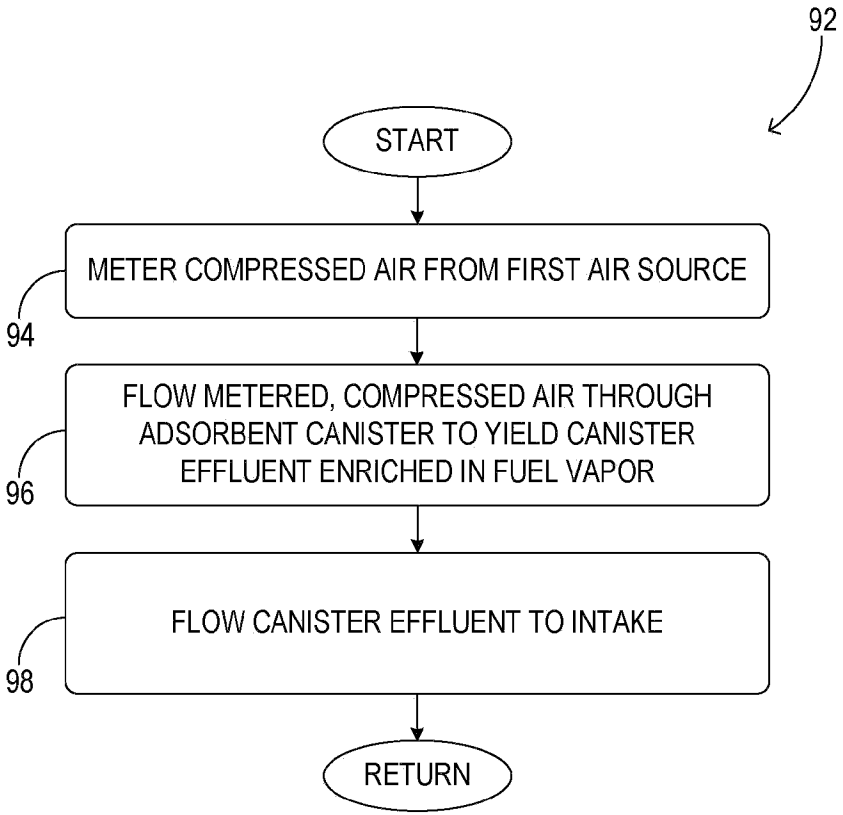

FIG. 7 illustrates an example method 92 for combusting a vapor of a fuel accumulated in an adsorbent canister coupled to a fuel tank of a vehicle (e.g., adsorbent canister 36). The method may be entered upon during a first operating condition of the vehicle. The first operating condition may be defined and characterized as described hereinabove, in the context of method 76.

Method 92 begins at 94, where compressed air from the first air source is metered. Metering the compressed air from the first air source, and the first air source itself, may be substantially as described hereinabove, in the context of method 76.

Method 92 then advances to 96, where the metered, compressed air is flowed through the adsorbent canister along a first flow path. As a result of flowing through the first flow path, the effluent from the adsorbent canister may become enriched in the vapor of the fuel adsorbed therein.

In some embodiments, the compressed air may be flowed through the adsorbent canister according to a purge-scheduling algorithm enacted in an electronic control system of the engine system (e.g., electronic control system 28). The purge scheduling algorithm may open a post-throttle canister-purge valve (e.g., post-throttle canister-purge valve 38) to allow air compressed by a turbocharger to flow into the adsorbent canister. Actions such as post-throttle canister-purge valve opening may be actively enabled during the first operating condition and actively disabled outside of the first operating condition. For example, the electronic control system may be adapted to enable canister purging, viz., to allow the post-throttle canister-purge valve to open only during the first operating condition.

Method 92 then advances to 98, where the canister effluent enriched in the fuel vapor is flown to an intake of the engine. Flowing the canister effluent to the intake of the engine may be enacted substantially as described hereinabove, in the context of flowing the crankcase effluent to the intake of the engine. Also, the related methods described with reference to the example configurations of FIGS. 1-4 (viz., cooling the compressed air before metering, flowing through a throttle valve and/or a metering valve different than the throttle valve) apply analogously. Following 98, method 92 returns.

Figure 8:
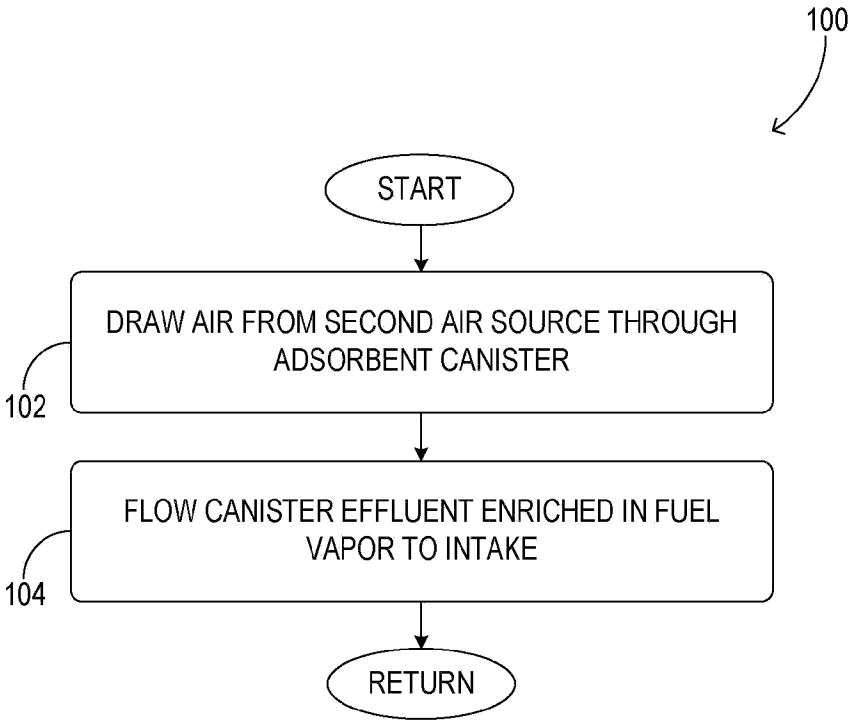
FIGS. 7 and 8 illustrate methods for combusting a vapor of a fuel accumulated in an adsorbent canister coupled to a fuel tank of a vehicle, in accordance with different embodiments of the present disclosure.

FIG. 8 illustrates another example method 100 for combusting a vapor of a fuel accumulated in an adsorbent canister coupled to a fuel tank of a vehicle. Method 100 may be entered upon during a second operating condition of the vehicle characterized as described above in the context of method 86.

Method 100 begins at 102, where air from a second air source is drawn through the adsorbent canister, and advances to 104, where the canister effluent enriched in the vapor of the accumulated fuel is flown into the intake of the engine. Method 100 is therefore analogous to method 86, and shares the analogous variations and extensions described in context of crankcase ventilation during the second operating condition (viz., the second air source, first and second flow paths, etc.).

In the context of adsorbent-canister purging, however, one or more actions actively enabled during the first operating condition may be actively disabled during the second operating condition. For example, the electronic control system may be adapted to disable canister purging, viz., to prevent the post-throttle canister-purge valve from opening, during the second operating condition—when TIP is below the BP threshold, for example.

Further, it will be understood that the various approaches described above for coordinating methods 76 and 86 for operating conditions when compressed air is relatively plentiful and operating conditions when compressed air is less plentiful are equally applicable to methods 92 and 100. Accordingly, a combined application of methods 92 and 100 enable effluent from the adsorbent canister to be flown to the intake of the engine during the first operating condition and during the second operating condition. Further extension of the method enables the fuel tank to be vented to an intake of the engine during the first and second operating conditions, as described hereinafter. In some embodiments, the fuel tank may be vented to the intake via a buffer.

It will be further noted that the example methods presented in FIGS. 7 and 8 apply no vacuum to the fuel tank during adsorbent-canister purge or other operating/resting conditions. Thus, the fuel tank may be maintained at barometric pressure during the first and second operating conditions.

Figure 9:
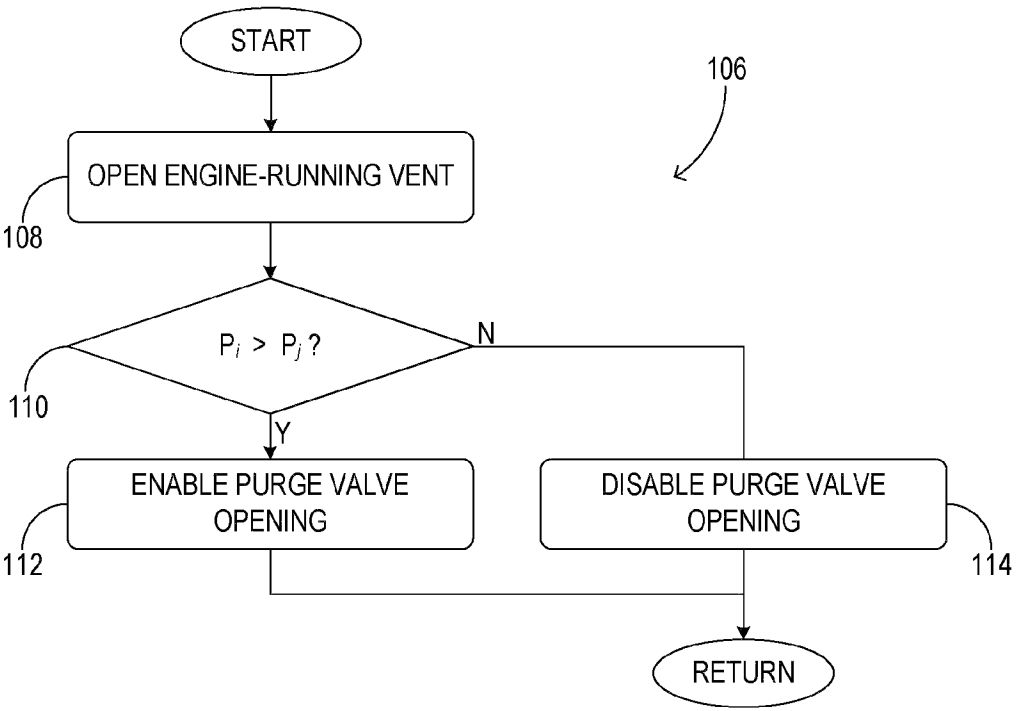
FIG. 9 illustrates a method for combusting a vapor of a fuel accumulated in an adsorbent canister coupled to a fuel tank of a vehicle, in accordance with an embodiment of the present disclosure.

FIG. 9 illustrates an example method 106 for combusting a vapor of a fuel accumulated in an adsorbent canister coupled to a fuel tank of a vehicle. Method 106 may be entered upon any time the vehicle is running. The method begins at 108, where an engine-running tank vent coupled to the fuel tank (e.g., engine-running tank vent 40) is opened. The method continues to 110, where a first measured pressure $P_1$ is compared to a second measured pressure $P_2$. If $P_1>P_2$, then at 112, electronic control system may enable a normally closed post-throttle canister-purge valve (e.g., post-throttle canister-purge valve 38) to open in response to a control signal from the electronic control system. However, if $P_1 \leqq P_2$, then at 114, electronic control system may disable the normally closed post-throttle canister-purge valve from opening. In this manner, canister purging may be allowed at each execution of 112 and forbidden at each execution of 114. After this action, or after 112, method 106 returns.

The first and second measured pressures referred to hereinabove may be defined differently in the various embodiments of the present disclosure. In one embodiment, $P_1$ may correspond to TIP, and $P_2$ may correspond to BP; accordingly, canister purging may be enabled only during boost conditions. In another embodiment, $P_1$ may correspond to TIP, and $P_2$ may correspond to MAP; accordingly, canister purging may be enabled practically any time the throttle is delivering a significant air flow to the engine.

Figure 10:
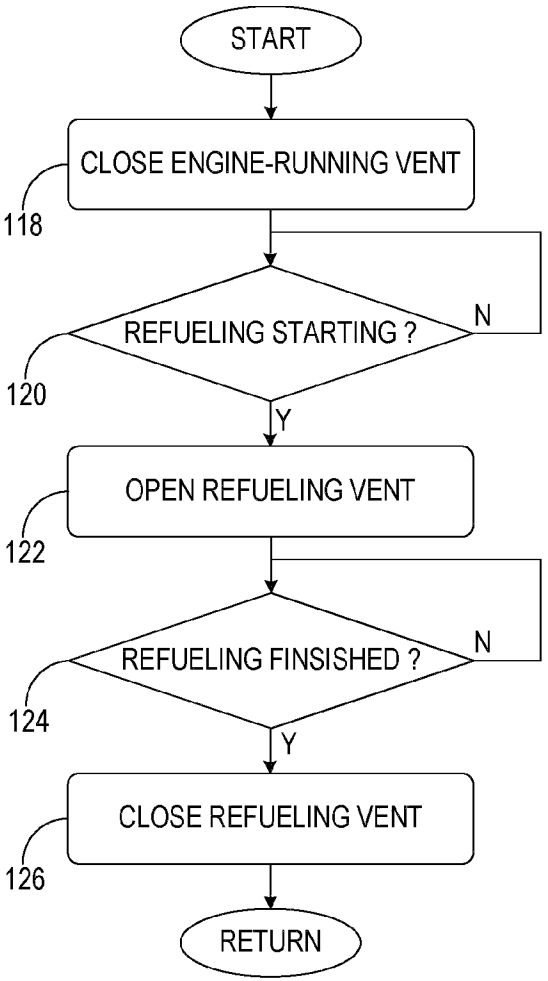
FIG. 10 illustrates a method for controlling two tank vents coupled to a fuel tank of a vehicle, in accordance with an embodiment of the present disclosure.

FIG. 10 illustrates an example method 116 for controlling two tank vents coupled to a fuel tank of a vehicle: an engine-running tank vent (e.g., engine-running tank vent 40), and a refueling tank vent (e.g., refueling tank vent 42). The method may be entered upon any time the vehicle is turned off, including but not limited to just before a refueling event. The method begins at 118, where the engine-running tank vent is closed. The method advances to 120, where it is determined whether the vehicle is being refueled. If it is determined that the vehicle is not being refueled, then the method returns to 118, where the determination is made again. However, if it is determined that the vehicle is being refueled, then the method advances to 122, where a refueling tank vent is opened. The method then advances to 124, where it is determined whether refueling is finished. If refueling is not finished, then the method returns to 124, where the determination is made again. However, if refueling is finished, then the method advances to 126, where the refueling tank vent is closed. Method 116 then returns.

Taken together, methods 106 and 116 illustrate, in one, non-limiting embodiment, a strategy for controlling the fuel tank vents and post-throttle canister-purge valve in configurations such as those shown hereinabove. These methods illustrate an approach for keeping the engine-running tank vent open when the engine is running and closed when the engine is not running. They further illustrate an approach for keeping the refueling tank vent open when the vehicle is being refueled and closed when the vehicle is not being refueled.

It will be understood that the example control and estimation routines disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in an electronic control system. It will be understood that some of the process steps described and/or illustrated herein may in some embodiments be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Finally, it will be understood that the articles, systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A method for combusting a vapor of a fuel accumulated in an adsorbent canister in a vehicle, the vehicle having an engine and a fuel tank coupled to the adsorbent canister, the method comprising:

storing the fuel as a liquid in the fuel tank;

during a first operating condition including a higher availability of compressed air, metering the compressed air from a first air source, and flowing the metered, compressed air through the adsorbent canister along a first flow path and flowing compressed air from the first air source through a crankcase to yield a crankcase effluent enriched in the vapor, and combining the crankcase effluent with an effluent from the adsorbent canister also enriched in the vapor;

during a second operating condition including a lower availability of compressed air, flowing air from a second air source through the adsorbent canister; and during the first and second operating conditions, venting the fuel tank to an intake of the engine and flowing effluent enriched in the vapor from the adsorbent canister to the intake of the engine.

2. The method of claim 1, where the first air source is a compressor coupled to the intake of the engine.

3. The method of claim 2, where the compressor is a turbocharger compressor mechanically coupled to a turbine driven by exhaust from the engine.

4. The method of claim 2, further comprising cooling the compressed air before metering and before flowing through the adsorbent canister.

5. The method of claim 2, further comprising flowing the compressed air through a throttle valve coupled to the intake of the engine before metering and before flowing through the adsorbent canister.

6. The method of claim 1, where a throttle valve is coupled to the intake of the engine, the method further comprising flowing the compressed air through a metering valve different than the throttle valve before flowing through the adsorbent canister.

7. The method of claim 1, where flowing the effluent enriched in the vapor from the adsorbent canister to the intake of the engine comprises admitting the effluent to a compressor coupled to the intake of the engine.

8. The method of claim 1, where the first operating condition includes a throttle-inlet pressure of the engine exceeding a manifold air pressure of the engine.

9. The method of claim 1, where the first operating condition includes a manifold air pressure of the engine exceeding barometric pressure.

10. The method of claim 1, where the first operating condition includes a throttle-inlet pressure of the engine exceeding barometric pressure.

11. The method of claim 1, where the second air source is the atmosphere, and where flowing the air through the adsorbent canister during the second operating condition comprises flowing the air along a second flow path, different than the first flow path.

12. The method of claim 1, where the second air source is a vacuum pump discharge of the vehicle, and where flowing the air through the adsorbent canister during the second operating condition comprises flowing the air along the first flow path.

13. The method of claim 1, where the second operating condition includes a manifold air pressure of the engine being less than barometric pressure.

14. A method for combusting a vapor of a fuel accumulated in an adsorbent canister in a vehicle, the vehicle having an engine and a fuel tank coupled to the adsorbent canister, the method comprising:

storing the fuel as a liquid in the fuel tank;

when a throttle-inlet pressure of the engine exceeds a threshold, enabling a first valve to open to allow air compressed by a compressor to flow into the adsorbent canister, causing the air to become enriched in the vapor;

when the throttle-inlet pressure of the engine is below the threshold, preventing the first valve from opening;

when the engine is running, opening a second valve to allow the vapor to flow from the fuel tank to an intake of the engine, and flowing an effluent enriched in the vapor into the intake of the engine, where the fuel tank of the vehicle communicates with an air cleaner coupled to the intake of the engine via the second valve, and with the adsorbent canister via a third valve, keeping the third valve closed when the engine is running or the vehicle is not being refueled, and keeping the third valve open when the vehicle is being refueled and closed.

15. The method of claim 14, where the threshold corresponds to barometric pressure.

16. The method of claim 14, where the threshold corresponds to a manifold air pressure of the engine.

17. An engine method, comprising:

during boosted conditions, flowing compressed intake air through an adsorbent canister coupled to a liquid fuel tank, and through an engine crankcase, and then combining crankcase effluent with canister effluent, both enriched in fuel vapor;

during unboosted conditions, flowing atmospheric air through the adsorbent canister; and during both conditions, venting the liquid fuel tank to an engine intake and flowing enriched effluent from the canister to the engine intake.

* * * * *